US009715185B2

(12) United States Patent
Kawamoto et al.

(10) Patent No.: US 9,715,185 B2
(45) Date of Patent: Jul. 25, 2017

(54) ELECTROSTATIC-IMAGE DEVELOPING TONER, ELECTROSTATIC-IMAGE DEVELOPER, AND TONER CARTRIDGE

(71) Applicant: FUJI XEROX CO., LTD., Tokyo (JP)

(72) Inventors: Yuka Kawamoto, Kanagawa (JP); Kotaro Yoshihara, Kanagawa (JP); Daisuke Ishizuka, Kanagawa (JP); Asafumi Fujita, Kanagawa (JP); Narumasa Sato, Kanagawa (JP); Erina Saito, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/934,557

(22) Filed: Nov. 6, 2015

(65) Prior Publication Data

US 2016/0357120 A1 Dec. 8, 2016

(30) Foreign Application Priority Data

Jun. 4, 2015 (JP) ..... 2015-114117

(51) Int. Cl.
*G03G 9/087* (2006.01)
*G03G 9/08* (2006.01)

(52) U.S. Cl.
CPC ..... *G03G 9/0819* (2013.01); *G03G 9/0821* (2013.01); *G03G 9/0827* (2013.01); *G03G 9/08728* (2013.01); *G03G 9/08755* (2013.01)

(58) Field of Classification Search
CPC ..... G03G 9/0825; G03G 9/08755; G03G 9/08728; G03G 9/0821
See application file for complete search history.

(56) References Cited

U.S. PATENT DOCUMENTS

| | | | | |
|---|---|---|---|---|
| 6,566,025 | B1 * | 5/2003 | McStravick | G03G 9/08711 430/108.11 |
| 7,314,697 | B2 * | 1/2008 | Mc Stravick | G03G 9/0808 430/108.1 |
| 8,252,493 | B2 * | 8/2012 | Kumar | G03G 9/08708 430/108.1 |
| 8,518,625 | B2 * | 8/2013 | Fukao | G03G 9/0804 430/108.1 |
| 8,703,374 | B2 * | 4/2014 | Sweeney | G03G 9/0819 430/108.11 |
| 9,023,567 | B2 * | 5/2015 | Bayley | G03G 9/09321 430/108.1 |
| 2006/0160007 | A1 * | 7/2006 | Kmiecik-Lawrynowicz | G03G 9/0804 430/108.3 |
| 2009/0246669 | A1 * | 10/2009 | Uno | G03G 9/0804 430/108.2 |
| 2009/0325099 | A1 * | 12/2009 | Watanabe | G03G 9/0806 430/108.4 |

FOREIGN PATENT DOCUMENTS

| | | | |
|---|---|---|---|
| JP | 2002-031903 | A | 1/2002 |
| JP | 2003-114544 | A | 4/2003 |
| JP | 2006-293295 | A | 10/2006 |

* cited by examiner

*Primary Examiner* — Christopher Rodee
(74) *Attorney, Agent, or Firm* — Sughrue Mion, PLLC

(57) ABSTRACT

An electrostatic-image developing toner includes a toner particle including a polyester resin and a styrene-(meth) acrylic resin, and an external additive including a poly[alkyl (meth)acrylate] particle. The amount of the poly[alkyl (meth)acrylate] particles is about 0.05 parts by mass or more and about 1.0 parts by mass or less relative to 100 parts by mass of the toner particle. The ratio $D50_P/D50_T$ of the number-average diameter $D50_P$ of the poly[alkyl (meth) acrylate] particles to the number-average diameter $D50_T$ of the toner particles satisfies $0.03 \leq D50_P/D50_T \leq 0.15$. The proportion of the styrene-(meth)acrylic resin in a resin component deposited on the surface of the toner particle is about 5 atom % or more and about 30 atom % or less as determined by X-ray photoelectron spectroscopy (XPS).

11 Claims, 2 Drawing Sheets

ELECTROSTATIC-IMAGE DEVELOPING TONER, ELECTROSTATIC-IMAGE DEVELOPER, AND TONER CARTRIDGE

CROSS-REFERENCE TO RELATED APPLICATIONS

This application is based on and claims priority under 35 USC 119 from Japanese Patent Application No. 2015-114117 filed Jun. 4, 2015.

BACKGROUND (i) Technical Field

The present invention relates to an electrostatic-image developing toner, an electrostatic-image developer, and a toner cartridge.

(ii) Related Art

With the advance of equipment and the development of communication networks in the information society, an electrophotographic process has been widely used in copying machines, network printers for offices, printers for personal computers, printers for on-demand printing, and the like. Accordingly, both monochrome printers and color printers are increasingly required to achieve high image quality, a high printing speed, high reliability, reductions in size and weight, and energy conservation.

In an electrophotographic process, in general, a fixed image is formed by the following multiple steps: electrically forming an electrostatic image on a photosensitive member (i.e., image carrier) including a photoconductive substance by any suitable method; developing the electrostatic image using a developer containing a toner; transferring the resulting developed image to a recording medium such as paper directly or via an intermediate transfer body; and fixing the resulting transferred image to the recording medium.

SUMMARY

According to an aspect of the invention, there is provided an electrostatic-image developing toner including a toner particle including a polyester resin and a styrene-(meth) acrylic resin, and an external additive including a poly[alkyl (meth)acrylate] particle. The amount of the poly[alkyl (meth)acrylate] particles is about 0.05 parts by mass or more and about 1.0 parts by mass or less or relative to 100 parts by mass of the toner particle. The ratio $D50_P/D50_T$ of the number-average diameter $D50_P$ of the poly[alkyl (meth) acrylate] particles to the number-average diameter $D50_T$ of the toner particles satisfies $0.03 \leq D50_P/D50_T \leq 0.15$. The proportion of the styrene-(meth)acrylic resin in a resin component deposited on the surface of the toner particle is about 5 atom % or more and about 30 atom % or less as determined by X-ray photoelectron spectroscopy (XPS).

BRIEF DESCRIPTION OF THE DRAWINGS

Exemplary embodiments of the present invention will be described in detail based on the following figures, wherein.

DETAILED DESCRIPTION

Figure 1:
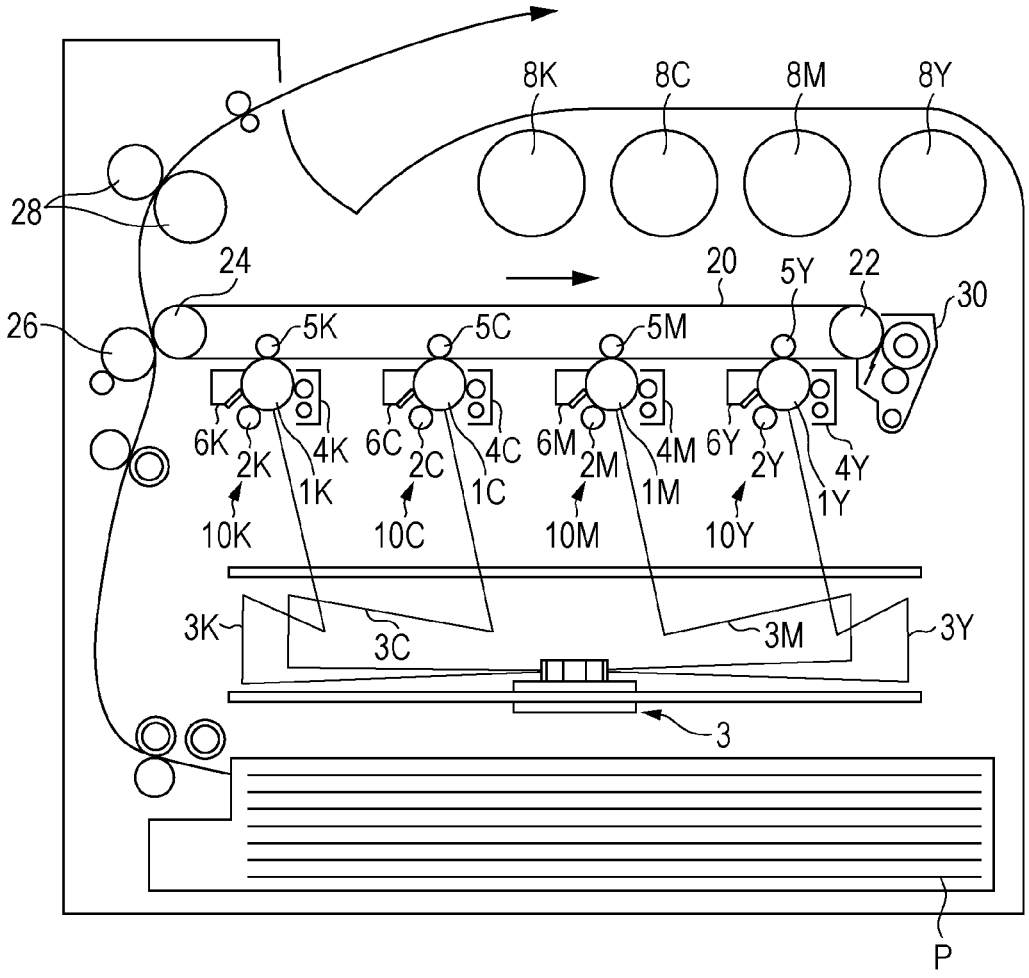
FIG. 1 schematically illustrates an image forming apparatus according to an exemplary embodiment.

An electrostatic-image developing toner, an electrostatic-image developer, a toner cartridge, a process cartridge, an image forming apparatus, and an image forming method according to the exemplary embodiments are described below in detail.

Electrostatic-Image Developing Toner

The electrostatic-image developing toner (hereinafter, referred to simply as "toner") according to an exemplary embodiment includes toner particles each including a polyester resin and a styrene-(meth)acrylic resin, and an external additive including poly[alkyl (meth)acrylate]particles. The toner satisfies the following conditions (1) to (3):

(1) the amount of the poly[alkyl (meth)acrylate] particles is 0.05 parts by mass or more and 1.0 parts by mass or less or about 0.05 parts by mass or more and about 1.0 parts by mass or less relative to 100 parts by mass of the toner particles;

(2) the ratio ($D50_P/D50_T$) of the number-average diameter $D50_P$ of the poly[alkyl (meth)acrylate] particles to the number-average diameter $D50_T$ of the toner particles satisfies $0.03 \leq D50_P/D50_T \leq 0.15$; and (3) the proportion of the styrene-(meth)acrylic resin in resin components deposited on the surfaces (hereinafter, referred to as "toner particle surfaces") of the toner particles is 5 atom % or more and 30 atom % or less or about 5 atom % or more and about 30 atom % or less as determined by X-ray photoelectron spectroscopy (XPS).

When a toner is stored at a high temperature over a long period of time, the toner gradually forms a closest-packed structure (i.e., becomes packed) due to its own weight and, as a result, the bulk density (e.g., packed bulk density) of the toner is increased. This is presumably because, in such a case, the likelihood of the external additive being buried in the toner particles due to the weight of the toner is increased, which consequently reduces the distances between the toner particles. If a toner having a high bulk density is used, the miscibility of the toner is likely to be degraded, ease of uniformly charging the toner is likely to be reduced, and consequently the gradation reproducibility of images may be degraded.

In order to address the above-described issue, the toner according to the exemplary embodiment includes toner particles each including a polyester resin and a styrene-(meth)acrylic resin, and an external additive including poly [alkyl (meth)acrylate] particles, the toner satisfying the conditions (1) to (3) described above. This reduces a change in the packed bulk density of the toner which occurs in a toner cartridge even when the toner is stored at a high temperature over a long period of time and, as a result, a change in the gradation reproducibility of images may be reduced.

It is considered that a change in the gradation reproducibility of images is reduced by the following mechanism.

In this exemplary embodiment, the amount of the poly [alkyl (meth)acrylate] particles is limited to be within the range described in the condition (1) above in order to increase the likelihood of the poly[alkyl (meth)acrylate] particles being present among the toner particles. This makes it easy to keep the distances between the toner particles.

Furthermore, the ratio $D50_P/D50_T$ of the number-average diameter $D50_P$ of the poly[alkyl (meth)acrylate] particles to the number-average diameter $D50_T$ of the toner particles is limited to be within the range described in the condition (2) above in order to control the diameter of the poly[alkyl (meth)acrylate] particles to be adequate relative to the diameter of the toner particles. Therefore, when the poly [alkyl (meth)acrylate] particles are present among the toner particles, it becomes easy to keep the distances between the toner particles. In addition, detachment of the poly[alkyl (meth)acrylate] particles is suppressed, which increases the likelihood of the poly[alkyl (meth)acrylate]particles being present among the toner particles.

Thus, since the toner according to the exemplary embodiment satisfies the conditions (1) and (2) above, the poly [alkyl (meth)acrylate] particles serve as spacers among the toner particles. This enables the distances between the toner particles to be maintained and consequently physical contact of the toner particles can be reduced.

In this exemplary embodiment, the proportion of the styrene-(meth)acrylic resin deposited on the toner particle surfaces is limited to be within the range described in the condition (3) above in order to deposit the styrene-(meth) acrylic resin and the polyester resin on the toner particle surfaces in specific proportions. A styrene-(meth)acrylic resin and a polyester resin have low compatibility with each other since they have different solubility parameters (SPs). Therefore, when these resins are deposited on the toner particle surfaces, a sea-island structure constituted by a sea region (i.e., region including the polyester resin) and an island region (i.e., region including the styrene-(meth) acrylic resin) is likely to be formed on each toner particle surface.

In the sea region (i.e., region including the polyester resin), which includes ester groups that are likely to generate an electrostatic repulsive force, the polyester resin and the poly[alkyl (meth)acrylate] particles are likely to repel each other electrostatically. In particular, under a high-temperature, high-humidity condition, where the electrostatic repulsive force of the ester groups is likely to occur locally, the electrostatic repulsive force between the polyester resin and the poly[alkyl (meth)acrylate]particles is more likely to occur in the sea region. This electrostatic repulsive force reduces the likelihood of the poly[alkyl (meth)acrylate] particles being buried in the toner particle surfaces.

On the other hand, the island region (i.e., region including the styrene-(meth)acrylic resin), on which the styrene-(meth)acrylic resin is deposited in the proportion described in the condition (3) above, increases the overall hardness of the toner particle surfaces compared with the case where only the sea region is formed on each toner particle surface. The increase in the hardness of the toner particle surfaces also contributes to the reduction in the likelihood of the poly[alkyl (meth)acrylate] particles being buried in the toner particle surfaces.

Thus, since the toner according to the exemplary embodiment satisfies the condition (3) above, the likelihood of the poly[alkyl (meth)acrylate] particles being buried in the toner particle surfaces during storage can be reduced even when the toner is stored at a high temperature over a long period of time.

Thus, the toner according to the exemplary embodiment, which satisfies the conditions (1) to (3) above, enables the physical contact among the toner particles and the likelihood of the poly[alkyl (meth)acrylate] particles, which serve as an external additive, being buried in the toner particle surfaces during storage to be reduced even when the toner is stored at a high temperature over a long period of time. This reduces the likelihood of the toner being packed due to the weight of the toner and, as a result, a change in the packed bulk density of the toner which occurs during storage may be reduced. This consequently reduces a change in the gradation reproducibility of images which occurs when the toner is stored in a toner cartridge at a high temperature over a long period of time.

The toner according to the exemplary embodiment is described below in detail.

The toner according to the exemplary embodiment includes toner particles and an external additive.

Toner Particles

The toner particles include a binder resin and a styrene-(meth)acrylic resin. The toner particles may optionally further include a colorant, a release agent, and other additives.

Binder Resin

A polyester resin may be used as a binder resin.

Examples of the polyester resin include various polyester resins known in the related art.

Examples of the polyester resin include condensation polymers of a polyvalent carboxylic acid and a polyhydric alcohol. The polyester resin may be a commercially available one or a synthesized one.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides of these dicarboxylic acids, and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher polyvalent carboxylic acids having a crosslinked structure or a branched structure may be used as a polyvalent carboxylic acid in combination with the dicarboxylic acid. Examples of the trivalent or higher polyvalent carboxylic acids include trimellitic acid, pyromellitic acid, anhydrides of these carboxylic acids, and lower (e.g., 1 to 5 carbon atoms) alkyl esters of these carboxylic acids.

The above-described polyvalent carboxylic acids may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., bisphenol A-ethylene oxide adduct and bisphenol A-propylene oxide adduct). Among these diols, for example, aromatic diols and alicyclic diols may be used as a polyhydric alcohol. In particular, aromatic diols may be used as a polyhydric alcohol.

Trihydric or higher polyhydric alcohols having a crosslinked structure or a branched structure may be used as a polyhydric alcohol in combination with the diols. Examples of the trihydric or higher polyhydric alcohols include glycerin, trimethylolpropane, and pentaerythritol.

The above-described polyhydric alcohols may be used alone or in combination of two or more.

The glass transition temperature (Tg) of the polyester resin is preferably 50° C. or more and 80° C. or less and is more preferably 50° C. or more and 65° C. or less or about 50° C. or more and about 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight-average molecular weight (Mw) of the polyester resin is preferably 5,000 or more and 1,000,000 or less and is more preferably 7,000 or more and 500,000 or less.

The number-average molecular weight (Mn) of the polyester resin is preferably 2,000 or more and 100,000 or less.

The molecular weight distribution Mw/Mn of the polyester resin is preferably 1.5 or more and 100 or less and is more preferably 2 or more and 60 or less.

The weight-average molecular weight and number-average molecular weight of the polyester resin are determined by gel permeation chromatography (GPC). Specifically, the molecular weights of the polyester resin are determined by GPC using a GPC "HLC-8120GPC" produced by Tosoh Corporation as measuring equipment, a column "TSKgel SuperHM-M (15 cm)" produced by Tosoh Corporation, and tetrahydrofuran (THF) as a solvent. The weight-average molecular weight and number-average molecular weight of the polyester resin are determined on the basis of the results of the measurement using a molecular-weight calibration curve based on monodisperse polystyrene standard samples.

The polyester resin may be produced by any suitable production method known in the related art. Specifically, the polyester resin may be produced by, for example, a method in which polymerization is performed at 180° C. or more and 230° C. or less and the pressure inside the reaction system is reduced as needed while water and alcohols that are generated by condensation are removed.

In the case where the raw materials, that is, monomers, are not dissolved or compatible with each other at the reaction temperature, a solvent having a high boiling point may be used as a dissolution adjuvant in order to dissolve the raw materials. In such a case, condensation polymerization is performed while the dissolution adjuvant is distilled away. In the case where the monomers used for copolymerization have low compatibility with each other, a condensation reaction of the monomers with an acid or alcohol that is to undergo a polycondensation reaction with the monomers may be performed and subsequently a polycondensation of the resulting polymers with the main components may be performed.

The content of the binder resin in the entire toner particles is, for example, preferably 40% by mass or more and 95% by mass or less, is more preferably 50% by mass or more and 90% by mass or less, and is further preferably 60% by mass or more and 85% by mass or less.

Binder resins other than the polyester resin may be used in combination with the polyester resin.

Examples of the other binder resins include vinyl resins (excluding a styrene-(meth)acrylic resin) that are homopolymers of the following monomers or copolymers of two or more monomers selected from the following monomers: styrenes (e.g., styrene, para-chlorostyrene, and α-methylstyrene), (meth)acrylates (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (e.g., acrylonitrile and methacrylonitrile), vinyl ethers (e.g., vinyl methyl ether and vinyl isobutyl ether), vinyl ketones (e.g., vinyl methyl ketone, vinyl ethyl ketone, and vinyl isopropenyl ketone), and olefins (e.g., ethylene, propylene, and butadiene).

Examples of the other binder resins further include non-vinyl resins such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The other binder resins may be used alone or in combination of two or more.

Styrene-(Meth)acrylic Resin

The styrene-(meth)acrylic resin is a copolymer produced by copolymerization of at least a monomer having a styrene skeleton and a monomer having a (meth)acrylic acid skeleton. The term "(meth)acrylic acid" used herein refers to both acrylic acid and methacrylic acid.

Examples of the monomer having a styrene skeleton (hereinafter, referred to as "styrene-based monomer") include styrene, alkyl-substituted styrenes (e.g., α-methylstyrene, 2-methylstyrene, 3-methylstyrene, 4-methylstyrene, 2-ethylstyrene, 3-ethylstyrene, and 4-ethylstyrene), halogen-substituted styrenes (e.g., 2-chlorostyrene, 3-chlorostyrene, and 4-chlorostyrene), and vinylnaphthalene. These styrene-based monomers may be used alone or in combination of two or more.

Among these styrene-based monomers, styrene may be used from the viewpoints of reactivity, ease of controlling a reaction, and availability.

Examples of the monomer having a (meth)acrylic acid skeleton (hereinafter, referred to as "(meth)acrylic acid-based monomer") include (meth)acrylic acid and (meth) acrylates. Examples of the (meth)acrylates include alkyl (meth)acrylates (e.g., methyl (meth)acrylate, ethyl (meth) acrylate, n-propyl (meth)acrylate, n-butyl (meth)acrylate, n-pentyl (meth)acrylate, n-hexyl acrylate, n-heptyl (meth) acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, neopentyl (meth)acrylate, isohexyl (meth)acrylate, isoheptyl (meth)acrylate, isooctyl (meth)acrylate, 2-ethylhexyl (meth)acrylate, cyclohexyl (meth)acrylate, and t-butylcyclohexyl (meth)acrylate); aryl (meth)acrylates (e.g., phenyl (meth)acrylate, biphenyl (meth)acrylate, diphenylethyl (meth)acrylate, t-butylphenyl (meth)acrylate, and terphenyl (meth)acrylate); dimethylaminoethyl (meth)acrylate; diethylaminoethyl (meth)acrylate; methoxyethyl (meth) acrylate; 2-hydroxyethyl (meth)acrylate; β-carboxyethyl (meth)acrylate; and (meth)acrylamide. These (meth)acrylic acid-based monomers may be used alone or in combination of two or more.

The ratio of the styrene-based monomer to the (meth) acrylic acid-based monomer in copolymerization (i.e., styrene-based monomer/(meth)acrylic acid-based monomer, on a mass basis) may be, for example, 85/15 to 70/30.

The styrene-(meth)acrylic resin may have a crosslinked structure in order to increase the hardness of the toner particle surfaces. An example of a styrene-(meth)acrylic resin having a crosslinked structure is a crosslinked product produced by copolymerization of at least the styrene-based monomer, the (meth)acrylic acid-based monomer, and a crosslinking monomer.

Examples of the crosslinking monomer include bifunctional or polyfunctional crosslinking agents.

Examples of bifunctional crosslinking agents include divinylbenzene, divinylnaphthalene, di(meth)acrylate compounds (e.g., diethylene glycol di(meth)acrylate, methylenebis(meth)acrylamide, decanediol diacrylate, and glycidyl (meth)acrylate), polyester-type di(meth)acrylate, and methacrylic acid-2-([1'-methylpropylideneamino]carboxyamino) ethyl.

Examples of polyfunctional crosslinking agents include tri(meth)acrylate compounds (e.g., pentaerythritol tri(meth) acrylate, trimethylolethane tri(meth)acrylate, and trimethylolpropane tri(meth)acrylate), tetra(meth)acrylate compounds (e.g., tetramethylolmethane tetra(meth)acrylate and oligoester (meth)acrylate), 2,2-bis(4-methacryloxy polyethoxyphenyl)propane, diallyl phthalate, triallyl cyanurate, triallyl isocyanurate, triallyl trimellitate, and diallyl chlorendate.

The ratio of the crosslinking monomer to the all monomers in copolymerization (i.e., crosslinking monomer/all monomers, on a mass basis) may be, for example, 2/1,000 to 30/1,000.

The weight-average molecular weight of the styrene-(meth)acrylic resin is, for example, 30,000 or more and 200,000 or less, is preferably 40,000 or more and 100,000 or less, and is more preferably 50,000 or more and 80,000 or less in order to increase the hardness of the toner particle surfaces.

The weight-average molecular weight of the styrene-(meth)acrylic resin is determined by the method used for determining the weight-average molecular weight of the polyester resin.

The combination of the styrene-based monomer and the (meth)acrylic acid-based monomer is preferably selected from the combinations described in 1) below, is more preferably selected from the combinations described in 2) below, and is further preferably selected from the combinations described in 3) below.

1) at least one styrene-based monomer selected from styrene, alkyl-substituted styrenes (e.g., α-methylstyrene, 2-methylstyrene, 3-methylstyrene, 4-methylstyrene, 2-ethylstyrene, 3-ethylstyrene, and 4-ethylstyrene), and halogen-substituted styrenes; and at least one (meth)acrylic acid-based monomer selected from butyl acrylate, methyl acrylate, and ethyl acrylate.

2) at least one styrene-based monomer selected from styrene and the above-described alkyl-substituted styrenes; and at least one (meth)acrylic acid-based monomer selected from butyl acrylate and ethyl acrylate.

3) a styrene-based monomer that is styrene; and a (meth) acrylic acid-based monomer that is butyl acrylate.

The proportion of the styrene-(meth)acrylic resin in resin components deposited on the toner particle surfaces is 5 atom % or more and 30 atom % or less or about 5 atom % or more and about 30 atom % or less, is preferably 5 atom % or more and 25 atom % or less, and is more preferably 5 atom % or more and 20 atom % or less as determined by X-ray photoelectron spectroscopy (XPS) in order to reduce the likelihood of the poly[alkyl (meth)acrylate] particles being buried in the toner particle surfaces.

The proportion (i.e., exposure ratio) of the styrene-(meth) acrylic resin in resin components deposited on the toner particle surfaces is determined by X-ray photoelectron spectroscopy (XPS). The XPS measurement is conducted with "JPS-9000MX" produced by JEOL Ltd. using MgKα radiation as an X-ray source at an acceleration voltage of 10 kV and an emission current of 30 mA. The amount of styrene-(meth)acrylic resin deposited on the toner particle surfaces is determined by a method in which peak separation of the C1s spectrum is performed. In the peak separation method, the C1s spectrum measured is separated into components using a fit curve obtained by a least square method. Peak separation of the C1s spectrum is performed on the basis of component spectra each corresponding to a specific one of the styrene-(meth)acrylic resin, the binder resin (i.e., polyester resin), and, when a release agent is used, a release agent that are used for preparing the toner particles, which are C1s spectra obtained by independently measuring the styrene-(meth)acrylic resin, the binder resin, and the release agent.

The styrene-(meth)acrylic resin may be synthesized by any polymerization method such as solution polymerization, precipitation polymerization, suspension polymerization, block polymerization, or emulsion polymerization. The polymerization reaction may be performed by any suitable process known in the related art, such as a batch process, a semi-continuous process, or a continuous process.

Among the above polymerization methods, solution polymerization in which a radical initiator is used may be employed. Examples of a solvent used in solution polymerization include organic solvents such as ethyl acetate, butyl acetate, acetone, methyl ethyl ketone, methyl isobutyl ketone, cyclohexanone, tetrahydrofuran, dioxane, N,N-dimethylformamide, N,N-dimethylacetamide, benzene, toluene, acetonitrile, methylene chloride, chloroform, dichloroethane, methanol, ethanol, 1-propanol, 2-propanol, and 1-butanol. These organic solvents may be used alone or in a mixture of two or more. These organic solvents may be mixed with water.

The polymerization temperature is set in relation to the molecular weight of the styrene-(meth)acrylic resin to be produced, the type of polymerization initiator used, and the like. Polymerization is generally performed at about 0° C. or more and about 100° C. or less and is preferably performed at 50° C. or more and 100° C. or less.

The reaction pressure may be set arbitrarily. In general, the reaction pressure is preferably set to 1 $kgf/cm^2$ or more and 100 $kgf/cm^2$ or less and is more preferably set to 1 $kgf/cm^2$ or more and 30 $kgf/cm^2$ or less. The reaction time is set to about 5 hours or more and about 30 hours or less. After the preparation of the styrene-(meth)acrylic resin, the styrene-(meth)acrylic resin may optionally be purified by performing reprecipitation or the like.

The type of the polymerization initiator is not particularly limited.

Examples of the polymerization initiator include, as water-soluble polymerization initiators, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, triphenyl peracetate, tert-butyl hydroperoxide, tert-butyl performate, tert-butyl peracetate, tert-butyl perbenzoate, tert-butyl phenylperacetate, tert-butyl methoxyperacetate, tert-butyl per-N-(3-toluyl)carbamate, ammonium bisulfate, and sodium bisulfate.

Examples of the polymerization initiator include, as oil-soluble polymerization initiators, azo-based polymerization initiators such as 2,2'-azobisisobutyronitrile, 2,2'-azobis(2,4-dimethyl)valeronitrile), 1,1'-azobis(cyclohexane-1-carbonitrile), and 2,2'-azobis-4-methoxy-2,4-dimethylvaleronitrile.

The amount of the styrene-(meth)acrylic resin is preferably set to 5 parts by mass or more and 30 parts by mass or less or about 5 parts by mass or more and about 30 parts by mass or less, is more preferably set to 10 parts by mass or more and 25 parts by mass or less, and is further preferably set to 15 parts by mass or more and 22 parts by mass or less relative to 100 parts by mass of the toner particles in order to reduce a change in the gradation reproducibility of images which occurs when the toner is stored at a high temperature over a long period of time.

Setting the amount of the styrene-(meth)acrylic resin to 5 parts by mass or more or about 5 parts by mass or more relative to 100 parts by mass of the toner particles reduces the likelihood of the poly[alkyl (meth)acrylate] particles being detached from the toner particle surfaces. In addition, the likelihood of the poly[alkyl (meth)acrylate]particles being detached and forming an aggregate while the toner is transported may also be reduced. Setting the amount of the styrene-(meth)acrylic resin to 30 parts by mass or less or about 30 parts by mass or less relative to 100 parts by mass of the toner particles enables the styrene-(meth)acrylic resin, which has a high affinity for the poly[alkyl (meth)acrylate] particles, to be exposed at the toner particle surfaces in the specific proportion. This reduces the likelihood of the poly [alkyl (meth)acrylate] particles being buried in the toner particle surfaces when the toner is stored at a high temperature.

The polyester resin described in 1-1) below and the styrene-(meth)acrylic resin described in 2-1) below are preferably used in combination. The polyester resin described in 1-2) below and the styrene-(meth)acrylic resin described in 2-2) below are more preferably used in combination.

1-1) a polyester resin produced using, as polymerizable monomers, at least one carboxylic-acid component selected from maleic acid, terephthalic acid, fumaric acid, 3-hexenedioic acid, and 3-octenedioic acid and at least one alcohol component selected from bisphenol A-ethylene oxide adduct, bisphenol A-propylene oxide adduct, propylene glycol, 1,3-butanediol, and glycerol.

1-2) a polyester resin produced using, as polymerizable monomers, terephthalic acid and at least one monomer selected from bisphenol A-ethylene oxide adduct and bisphenol A-propylene oxide adduct.

2-1) a styrene-(meth)acrylic resin produced using, as polymerizable monomers, styrene and at least one acrylic-acid-based material selected from (meth)acrylic acid and butyl (meth)acrylate.

2-2) a styrene-acrylic acid copolymer produced using, as polymerizable monomers, styrene and butyl acrylate.

Colorant

Examples of the colorant include various pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the entire toner particles is preferably set to, for example, 1% by mass or more and 30% by mass or less and is more preferably set to 3% by mass or more and 15% by mass or less.

Release Agent

Examples of the release agent include, but are not limited to, hydrocarbon waxes; natural waxes such as a carnauba wax, a rice bran wax, and a candelilla wax; synthetic or mineral-petroleum-derived waxes such as a montan wax; and ester waxes such as a fatty-acid ester wax and a montanate wax.

The melting temperature of the release agent is preferably 50° C. or more and 110° C. or less and is more preferably 60° C. or more and 100° C. or less or about 60° C. or more and about 100° C. or less.

The melting temperature of the release agent is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The content of the release agent in the entire toner particles is preferably, for example, 1% by mass or more and 20% by mass or less and is more preferably 5% by mass or more and 15% by mass or less.

Other Additives

Examples of the other additives include various additives known in the related art, such as a magnetic substance, a charge-controlling agent, and an inorganic powder. These additives may be added to the toner particles as internal additives.

Properties, Etc. of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including the binder resin and, as needed, other additives such as a colorant and a release agent and by a coating layer including the binder resin.

The shape factor SF1 of the toner particles is preferably 110 or more and 150 or less and is more preferably 120 or more and 140 or less or about 120 or more and about 140 or less.

The shape factor SF1 of the toner particles can be determined using the following formula:

$$SF1=(ML^2/A)\times(\pi/4)\times 100$$

where ML represents the absolute maximum length of the toner particles and A represents the projected area of the toner particles.

Specifically, the shape factor SF1 of the toner particles is determined by analyzing a microscope image or scanning electron microscope (SEM) image of the toner particles using an image processor in the following manner. An optical microscope image of toner particles spread over the surface of a glass slide is loaded into a LUZEX image processor using a video camera. The maximum lengths and projected areas of 100 toner particles are measured. The shape factors SF1 of the 100 toner particles are calculated using the above formula, and the average of the shape factors SF1 is obtained.

Number-Average Diameter $D50_T$ of Toner Particles

The number-average diameter $D50_T$ of the toner particles is preferably 3 μm or more and 12 μm or less, is more preferably 3 μm or more and 8 μm or less, and is further preferably 3.5 μm or more and 7.5 μm or less in order to make it easy to control the ratio $D50_P/D50_T$ of the number-average diameter $D50_P$ of the poly[alkyl (meth)acrylate] particles to the number-average diameter of the toner particles.

The number-average diameter $D50_T$ of the toner particles is determined by the following method.

Images of 100 first toner particles are taken using a scanning electron microscope (SEM, "S-4100" produced by Hitachi, Ltd.). The images are loaded into an image processor (LUZEXIII, produced by NIRECO CORPORATION). For each first particle, the longest and shortest diameters of the first particle are measured by analyzing the image of the particle, and the equivalent circle diameter of the first particle is measured on the basis of the intermediate value thereof. The 50%-diameter (D50) of the cumulative frequency of the equivalent circle diameters measured is considered to be the number-average diameter $D50_T$ of the toner particles. The magnification factor of the electron microscope is adjusted such that about 10 to 50 toner particles are taken per a field of view, and images taken in plural fields of view are merged together in order to determine the equivalent circle diameters of the first particles.

External Additive

Poly[Alkyl (Meth)acrylate] Particles

The toner according to the exemplary embodiment includes an external additive including poly[alkyl (meth) acrylate] particles. Poly[alkyl (meth)acrylate] is a copolymer produced by copolymerization of at least an alkyl (meth)acrylate as a monomer. The term "(meth)acrylate" used herein refers to both "acrylate" and "methacrylate".

Examples of the alkyl (meth)acrylate include the alkyl (meth)acrylates described above as examples of (meth) acrylates. The alkyl (meth)acrylates may be used alone or in combination of two or more. It is possible to use (meth) acrylic acid as a monomer in combination with the alkyl (meth)acrylates.

The number of carbon atoms included in the alkyl chain of the poly[alkyl (meth)acrylate] particles, that is, the number of carbon atoms included in the alkyl chain of the alkyl (meth)acrylate, is preferably 1 to 5, is more preferably 1 to 4, and is further preferably 1 to 3 in order to reduce a change in the gradation reproducibility of images which occurs when the toner is stored at a high temperature over a long period of time.

Setting the number of carbon atoms included in the alkyl chain to be within the above ranges prevents an excessive reduction in glass transition temperature (Tg) from occurring and thereby enhances the durability of the toner in storage at a high temperature.

Content of Poly[Alkyl (Meth)acrylate] Particles

The amount of the poly[alkyl (meth)acrylate] particles is set to 0.05 parts by mass or more and 1.0 parts by mass or less or about 0.05 parts by mass or more and about 1.0 parts by mass or less, is preferably set to 0.05 parts by mass or more and 0.5 parts by mass or less, and is more preferably set to 0.08 parts by mass or more and 0.2 parts by mass or less relative to 100 parts by mass of the toner particles in order to reduce a change in the gradation reproducibility of images which occurs when the toner is stored at a high temperature over a long period of time.

Setting the amount of the poly[alkyl (meth)acrylate]particles to 0.05 parts by mass or more or about 0.05 parts by mass or more relative to 100 parts by mass of the toner particles increases the likelihood of the poly[alkyl (meth) acrylate] particles being present among the toner particles, which makes it easy to keep the distances between the toner particles. Setting the amount of the poly[alkyl (meth)acrylate] particles to 1.0 parts by mass or less or about 1.0 parts by mass or less relative to 100 parts by mass of the toner particles reduces the likelihood of the poly[alkyl (meth) acrylate] particles aggregating together. This reduces the amount of poly[alkyl (meth)acrylate]particles that adhere to a developing member (e.g., developing roller) during developing, which suppresses formation of white dots on images.

Number-Average Diameter $D50_P$ of Poly[Alkyl (Meth) acrylate] Particles

The number-average diameter $D50_P$ of the poly[alkyl (meth)acrylate] particles is preferably 200 nm or more and 800 nm or less or about 200 nm or more and about 800 nm or less, is more preferably 250 nm or more and 600 nm or less, and is further preferably 300 nm or more and 500 nm or less in order to reduce a change in the gradation reproducibility of images which occurs when the toner is stored at a high temperature over a long period of time.

The number-average diameter $D50_P$ of the poly[alkyl (meth)acrylate] particles is determined as in the determination of the number-average diameter $D50_T$ of the toner particles.

Ratio ($D50_P/D50_T$) of Number-Average Diameter $D50_P$ of Poly[Alkyl (Meth)acrylate] Particles to Number-Average Diameter $D50_T$ of Toner Particles The ratio $D50_P/D50_T$ of the number-average diameter $D50_P$ of the poly[alkyl (meth)acrylate] particles to the number-average diameter $D50_T$ of the toner particles satisfies $0.03 \leq D50_P/D50_T \leq 0.15$, preferably satisfies $0.05 \leq D50_P/D50_T \leq 0.12$, and more preferably satisfies $0.05 \leq D50_P/D50_T \leq 0.10$ in order to reduce a change in the gradation reproducibility of images which occurs when the toner is stored at a high temperature over a long period of time.

When the ratio $D50_P/D50_T$ is limited to 0.03 or more, the size of the poly[alkyl (meth)acrylate] particles is adequate relative to that of the toner particles. When such poly[alkyl (meth)acrylate] particles are present among the toner particles, it becomes easy to keep the distances between the toner particles. Setting the ratio $D50_P/D50_T$ to 0.15 or less reduces the likelihood of the poly[alkyl (meth)acrylate] particles being detached and the electrification characteristics of the toner may be enhanced.

Other External Additives

External additives other than the poly[alkyl (meth)acrylate] particles may be used in combination with the poly [alkyl (meth)acrylate] particles.

Examples of the other external additives include inorganic particles such as $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO.SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles. These inorganic particles may be used alone or in combination of two or more.

The surfaces of the inorganic particles used as the other external additive may be hydrophobized. The surfaces of the inorganic particles can be hydrophobized by, for example, immersing the inorganic particles in a hydrophobizing agent. Examples of the hydrophobizing agent include, but are not particularly limited to, a silane coupling agent, silicone oil, a titanate coupling agent, and aluminium coupling agent. These hydrophobizing agents may be used alone or in combination of two or more.

In general, the amount of the hydrophobizing agent is set to, for example, 1 part by mass or more and 10 parts by mass or less relative to 100 parts by mass of the inorganic particles.

Examples of the other external additives also include resin particles other than the poly[alkyl (meth)acrylate]particles (e.g., polystyrene particles and melamine particles) and cleaning activators (particles of a metal salt of a higher fatty acid, such as zinc stearate, and particles of a fluorine-based polymer).

The amount of the other external additive is, for example, preferably 2 parts by mass or more and 10 parts by mass or less and is more preferably 3 parts by mass or more and 8 parts by mass or less relative to 100 parts by mass of the toner particles.

Properties of Toner

Ratio of Packed Bulk Density Measured after Storage and Packed Bulk Density Measured Before Storage The ratio of the packed bulk density of the toner according to the exemplary embodiment which has been stored to the packed bulk density of the toner which is measured before the toner is stored (i.e., packed bulk density after storage/packed bulk density before storage) is preferably set to 1.03 or less or about 1.03 or less and is more preferably set to 1.02 or less in order to reduce a change in the gradation reproducibility of images which occurs when the toner is stored at a high temperature over a long period of time. The ratio of packed bulk density after storage to packed bulk density before storage may be set to be as near as possible to 1. Hereinafter, the "ratio of packed bulk density after storage to packed bulk density before storage" is referred to as "ratio of a change in packed bulk density".

Specifically, the term "packed bulk density after storage" used herein refers to the packed bulk density of the toner that has been stored in a toner cartridge at a high temperature (40° C.) for 20 hours.

Packed bulk density after storage is determined in the following manner.

A toner to be measured is charged into a container having a diameter of 5 cm, a height of 5.2 cm, and a volume of 100 $cm^3$ to which a supplied cap is attached. An impact (i.e., tapping) is repeatedly performed on the bottom of the container 180 times. After tapping is completed, the cap is removed and the excess portion of the toner protruding from the container is leveled off. The packed bulk density [$g/cm^3$] of the toner is determined from the amount of the toner charged in the container.

Method for Producing Toner

A method for producing the toner according to the exemplary embodiment is described below.

The toner according to the exemplary embodiment is produced by, after preparation of the toner particles, depositing an external additive on the surfaces of the toner particles.

The toner particles may be prepared by any dry process (e.g., knead pulverization) or any wet process (e.g., aggregation coalescence, suspension polymerization, or dissolution suspension). However, a method for preparing the toner particles is not particularly limited thereto, and any suitable method known in the related art may be used.

Among these methods, aggregation coalescence may be employed in order to prepare the toner particles.

Specifically, in the case where, for example, aggregation coalescence is employed in order to prepare the toner particles, the toner particles are prepared by the following steps:

preparing a resin particle dispersion in which resin particles serving as a binder resin are dispersed (i.e., resin particle dispersion preparation step);

causing the resin particles (and, as needed, other particles) to aggregate together in the resin particle dispersion (or in the resin particle dispersion mixed with another particle dispersion as needed) in order to form aggregated particles (i.e., aggregated particle formation step);

and heating the resulting aggregated particle dispersion in which the aggregated particles are dispersed in order to cause fusion and coalescence of the aggregated particles to occur and thereby form toner particles (fusion-coalescence step).

The above-described steps are each described below in detail.

Hereinafter, a method for preparing toner particles including a colorant and a release agent is described. However, it should be noted that the colorant and the release agent are optional. It is needless to say that additives other than a colorant and a release agent may be used.

Resin Particle Dispersion Preparation Step

In addition to a resin particle dispersion in which resin particles serving as a binder resin is dispersed, for example, a colorant particle dispersion in which colorant particles are dispersed and a release-agent particle dispersion in which release-agent particles are dispersed are prepared.

The resin particle dispersion is prepared by, for example, dispersing resin particles in a dispersion medium using a surfactant.

Examples of the dispersion medium used for preparing the resin particle dispersion include aqueous media.

Examples of the aqueous media include water such as distilled water and ion-exchange water and alcohols. These aqueous media may be used alone or in combination of two or more.

Examples of the surfactant include anionic surfactants such as sulfate-based surfactants, sulfonate-based surfactants, and phosphate-based surfactants; cationic surfactants such as amine-salt-based surfactants and quaternary-ammonium-salt-based surfactants; and nonionic surfactants such as polyethylene-glycol surfactants, alkylphenol-ethylene-oxide-adduct-based surfactants, and polyhydric-alcohol-based surfactants. Among these surfactants, in particular, the anionic surfactants and the cationic surfactants may be used. The nonionic surfactants may be used in combination with the anionic surfactants and the cationic surfactants.

These surfactants may be used alone or in combination of two or more.

In the preparation of the resin particle dispersion, the resin particles can be dispersed in a dispersion medium by any suitable dispersion method commonly used in the related art in which, for example, a rotary-shearing homogenizer, a ball mill, a sand mill, or a dyno mill that includes media is used. Depending on the type of the resin particles used, the resin particles may be dispersed in the resin particle dispersion by, for example, phase-inversion emulsification.

Phase-inversion emulsification is a method in which the resin to be dispersed is dissolved in a hydrophobic organic solvent in which the resin is soluble, a base is added to the resulting organic continuous phase (i.e., O phase) to perform neutralization, subsequently an aqueous medium (i.e., W phase) is charged to convert the resin, that is, to invert a phase thereof, from W/O to O/W, in order to create a discontinuous phase, and thereby the resin is dispersed in the aqueous medium in the form of particles.

The volume-average diameter of the resin particles dispersed in the resin particle dispersion is preferably set to, for example, 0.01 μm or more and 1 μm or less, is more preferably set to 0.08 μm or more and 0.8 μm or less, and is further preferably set to 0.1 μm or more and 0.6 μm or less.

The volume-average diameter of the resin particles is determined in the following manner. The particle diameter distribution of the resin particles is measured using a laser-diffraction-type particle-diameter-distribution measurement apparatus (e.g., "LA-700" produced by HORIBA, Ltd.). The particle diameter distribution measured is divided into a number of particle diameter ranges (i.e., channels). For each range, in ascending order in terms of particle diameter, the cumulative volume is calculated and plotted to draw cumulative distribution curve. A particle diameter at which the cumulative distribution is 50% relative to all particles is considered to be the volume-average diameter D50v. The volume-average diameters of particles included in the other dispersions are also determined in the above-described manner.

The content of the resin particles included in the resin particle dispersion is preferably set to, for example, 5% by mass or more and 50% by mass or less and is more preferably set to 10% by mass or more and 40% by mass or less.

The colorant particle dispersion, the release-agent particle dispersion, and the like are also prepared as in the preparation of the resin particle dispersion. In other words, the above-described specifications for the volume-average diameter of the particles included in the resin particle dispersion, the dispersion medium of the resin particle dispersion, the dispersion method used for preparing the resin particle dispersion, and the content of the particles in the resin particle dispersion can also be applied to colorant particles dispersed in the colorant particle dispersion and release-agent particles dispersed in the release-agent particle dispersion.

Aggregated Particle Formation Step

The resin particle dispersion is mixed with the colorant particle dispersion and the release-agent particle dispersion.

In the resulting mixed dispersion, heteroaggregation of the resin particles with the colorant particles and the release-agent particles is performed in order to form aggregated particles including the resin particles, the colorant particles, and the release-agent particles, the aggregated particles having a diameter close to that of the desired toner particles.

Specifically, for example, a flocculant is added to the mixed dispersion, and the pH of the mixed dispersion is controlled to be acidic (e.g., pH of 2 or more and 5 or less). A dispersion stabilizer may be added to the mixed dispersion as needed. Subsequently, the mixed dispersion is heated to the glass transition temperature of the resin particles (specifically, e.g., [glass transition temperature of the resin particles—30° C.] or more and [the glass transition temperature—10° C.] or less), and thereby the particles dispersed in the mixed dispersion are caused to aggregate together to form aggregated particles.

In the aggregated particle formation step, alternatively, for example, the above-described flocculant may be added to the mixed dispersion at room temperature (e.g., 25° C.) while the mixed dispersion is stirred using a rotary-shearing homogenizer. Then, the pH of the mixed dispersion is controlled to be acidic (e.g., pH of 2 or more and 5 or less), and a dispersion stabilizer may be added to the mixed dispersion as needed. Subsequently, the mixed dispersion is heated in the above-described manner.

Examples of the flocculant include surfactants, inorganic metal salts, and divalent or higher polyvalent metal complexes that have a polarity opposite to that of the surfactant that is added to the mixed dispersion as a dispersant. In particular, using a metal complex as a flocculant reduces the amount of surfactant used and, as a result, charging characteristics may be enhanced.

An additive capable of forming a complex or a bond similar to a complex with the metal ions contained in the flocculant such as a chelating agent may optionally be used.

Examples of the inorganic metal salts include metal salts such as calcium chloride, calcium nitrate, barium chloride, magnesium chloride, zinc chloride, aluminium chloride, and aluminium sulfate; and inorganic metal salt polymers such as polyaluminium chloride, polyaluminium hydroxide, and calcium polysulfide.

The chelating agent may be a water-soluble chelating agent. Examples of such a chelating agent include oxycarboxylic acids such as tartaric acid, citric acid, and gluconic acid, imino diacid (IDA), nitrilotriacetic acid (NTA), and ethylenediaminetetraacetic acid (EDTA).

The amount of the chelating agent used is preferably 0.01 parts by mass or more and 5.0 parts by mass or less and is more preferably 0.1 parts by mass or more and less than 3.0 parts by mass relative to 100 parts by mass of the resin particles.

Fusion-Coalescence Step

The aggregated particle dispersion in which the aggregated particles are dispersed is heated to, for example, the glass transition temperature of the resin particles or more (e.g., temperature higher than the glass transition temperature of the resin particles by 10 to 30° C.) in order to perform fusion and coalescence of the aggregated particles. Thus, toner particles are prepared.

The toner particles are prepared through the above-described steps.

It is also possible to prepare the toner particles by, after preparing the aggregated particle dispersion in which the aggregated particles are dispersed, further mixing the aggregated particle dispersion with a resin particle dispersion in which resin particles are dispersed and subsequently performing aggregation such that the resin particles are deposited on the surfaces of the aggregated particles in order to form second aggregated particles; and by heating the resulting second-aggregated particle dispersion in which the second aggregated particles are dispersed and thereby causing fusion and coalescence of the second aggregated particles to occur in order to form toner particles having a core-shell structure.

After the completion of the fusion-coalescence step, the toner particles formed in the solution are subjected to a cleaning step, a solid-liquid separation step, and a drying step that are known in the related art in order to obtain dried toner particles.

In the cleaning step, the toner particles may be subjected to displacement washing using ion-exchange water to a sufficient degree from the viewpoint of electrification characteristics. Examples of a solid-liquid separation method employed in the solid-liquid separation step include, but are not limited to, suction filtration and pressure filtration from the viewpoint of productivity. Examples of a drying method employed in the drying step include, but are not particularly limited to, freeze-drying, flash-jet drying, fluidized drying, and vibrating fluidized drying from the viewpoint of productivity.

The toner according to the exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

In the toner particles according to the exemplary embodiment, which are prepared through the above-described steps, the proportion of the styrene-(meth)acrylic resin in the resin component deposited on the toner particle surfaces is set to 5 atom % or more and 30 atom % or less or about 5 atom % or more and about 30 atom % or less as determined by X-ray photoelectron spectroscopy (XPS).

In the case where the proportion (i.e., exposure ratio) of the styrene-(meth)acrylic resin is set to be within the above-described range, any dry process (e.g., knead pulverization) or any wet process (e.g., aggregation coalescence, suspension polymerization, or dissolution suspension) may be employed in order to prepare the toner particles. A method for producing the toner particles is not particularly limited to the above-described production methods, and any publicly known production method may be employed.

For example, forming toner particles having a structure constituted by a core (i.e., core particles) and a coating layer (i.e., shell layer) covering the core, that is, a "core-shell" structure, enables the proportion of styrene-(meth)acrylic resin exposed at the toner particle surfaces to be controlled. Specifically, for example, the proportion of styrene-(meth) acrylic resin exposed at the toner particle surfaces may be controlled by changing the content of the styrene-(meth) acrylic resin particles in the coating layer. In another case, the proportion of styrene-(meth)acrylic resin exposed at the toner particle surfaces may be controlled by adding the styrene-(meth)acrylic resin particles to the cores and changing the amount of the coating layer.

It is also possible to control the proportion of styrene-(meth)acrylic resin exposed at the toner particle surfaces by, after the preparation of the toner particles, subjecting a mixture of the toner particles and the styrene-(meth)acrylic resin particles to a mechanical treatment in which a mechanical force such as an impact force, a pressure, or a shearing force is applied to the mixture and thereby depositing the styrene-(meth)acrylic resin on the toner particle surfaces. The proportion of styrene-(meth)acrylic resin exposed at the toner particle surfaces can be controlled by changing the amount of the styrene-(meth)acrylic resin particles deposited on the toner particle surfaces. Examples of an apparatus used in the mechanical treatment include "ANGMILL" (produced by HOSOKAWA MICRON CORPORATION), "Hybridization" (produced by Nara Machinery Co., Ltd.), "KRYPTRON" (produced by EARTHTECHNICA CO., LTD.), and "NOBILTA" (produced by HOSOKAWA MICRON CORPORATION).

Electrostatic-Image Developer

The electrostatic-image developer according to an exemplary embodiment includes at least the toner according to the above-described exemplary embodiment.

The electrostatic-image developer according to the exemplary embodiment may be a monocomponent developer including only the above-described toner or may be a two-component developer that is a mixture of the above-described toner and a carrier.

The type of the carrier is not particularly limited, and any suitable carrier known in the related art may be used. Examples of the carrier include a coated carrier prepared by coating the surfaces of cores including magnetic powder particles with a coat resin; a magnetic-powder-dispersed carrier prepared by dispersing and mixing magnetic powder particles in a matrix resin; and a resin-impregnated carrier prepared by impregnating a porous magnetic powder with a resin.

The magnetic-powder-dispersed carrier and the resin-impregnated carrier may also be prepared by coating particles constituting the carrier, that is, core particles, with a coat resin.

Examples of the magnetic powder include powders of magnetic metals such as iron, nickel, and cobalt; and powders of magnetic oxides such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid copolymer, a straight silicone resin including an organosiloxane bond and the modified products thereof, a fluorine resin, polyester, polycarbonate, a phenolic resin, and an epoxy resin.

The coat resin and the matrix resin may optionally include additives such as conductive particles.

Examples of the conductive particles include particles of metals such as gold, silver, and copper; and particles of carbon black, titanium oxide, zinc oxide, tin oxide, barium sulfate, aluminium borate, and potassium titanate.

The surfaces of the cores can be coated with a coat resin by, for example, using a coating-layer forming solution prepared by dissolving the coat resin and, as needed, various types of additives in a suitable solvent. The type of the solvent is not particularly limited and may be selected with consideration of the coat resin used, ease of applying the coating-layer forming solution, and the like.

Specific examples of a method for coating the surfaces of the cores with the coat resin include an immersion method in which the cores are immersed in the coating-layer forming solution; a spray method in which the coating-layer forming solution is sprayed onto the surfaces of the cores; a fluidized-bed method in which the coating-layer forming solution is sprayed onto the surfaces of the cores while the cores are floated using flowing air; and a kneader-coater method in which the cores of the carrier are mixed with the coating-layer forming solution in a kneader coater and subsequently the solvent is removed.

The mixing ratio (i.e., mass ratio) of the toner to the carrier in the two-component developer is preferably set to toner:carrier=1:100 to 30:100 and is more preferably set to 3:100 to 20:100.

Image Forming Apparatus and Image Forming Method

The image forming apparatus and the image forming method according to an exemplary embodiment are described below.

The image forming apparatus according to the exemplary embodiment includes an image carrier; a charging unit that charges the surface of the image carrier; an electrostatic-image forming unit that forms an electrostatic image on the surface of the image carrier charged; a developing unit that includes an electrostatic-image developer and develops the electrostatic image formed on the surface of the image carrier using the electrostatic-image developer to form a toner image; a transfer unit that transfers the toner image formed on the surface of the image carrier onto the surface of a recording medium; and a fixing unit that fixes the toner image onto the surface of the recording medium. The electrostatic-image developer according to the above-described exemplary embodiment is used as an electrostatic-image developer.

The image forming apparatus according to the exemplary embodiment employs an image forming method (image forming method according to the exemplary embodiment) including charging the surface of the image carrier; forming an electrostatic image on the surface of the charged image carrier; developing the electrostatic image formed on the surface of the image carrier using the electrostatic-image developer according to the above-described exemplary embodiment to form a toner image; transferring the toner image formed on the surface of the image carrier onto the surface of a recording medium; and fixing the toner image onto the surface of the recording medium.

The image forming apparatus according to the exemplary embodiment may be any image forming apparatus known in the related art, such as a direct-transfer-type image forming apparatus in which a toner image formed on the surface of the image carrier is directly transferred to a recording medium; an intermediate-transfer-type image forming apparatus in which a toner image formed on the surface of the image carrier is transferred onto the surface of the intermediate transfer body in the first transfer step and the toner image transferred on the surface of the intermediate transfer body is again transferred onto the surface of a recording medium in the second transfer step; an image forming apparatus including a cleaning unit that cleans the surface of the image carrier subsequent to transfer of the toner image before the image carrier is again charged; and an image forming apparatus including a static-eliminating unit that eliminates static by irradiating, after the toner image has been transferred, the surface of the image carrier to be again charged with static-eliminating light.

The intermediate-transfer-type image forming apparatus may include a transfer unit constituted by, for example, an intermediate transfer body to which a toner image is transferred, a first transfer subunit that transfers a toner image formed on the surface of the image carrier onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including the developing unit may have a cartridge structure (i.e., process cartridge) detachably attached to the image forming apparatus. An example of the process cartridge is a process cartridge including a developing unit including the electrostatic-image developer according to the above-described exemplary embodiment.

An example of the image forming apparatus according to the exemplary embodiment is described below, but the image forming apparatus is not limited thereto. Only components shown in drawings are described; others are omitted.

FIG. 1 schematically illustrates the image forming apparatus according to the exemplary embodiment.

The image forming apparatus illustrated in FIG. 1 includes first to fourth electrophotographic image forming units 10Y, 10M, 10C, and 10K that form yellow (Y), magenta (M), cyan (C), and black (K) images, respectively, on the basis of color separation image data. The image forming units (hereafter, referred to simply as "units") 10Y, 10M, 10C, and 10K are horizontally arranged in parallel at a predetermined distance from one another. The units 10Y, 10M, 10C, and 10K may be process cartridges detachably attached to the image forming apparatus.

An intermediate transfer belt 20 serving as an intermediate transfer body runs above and extends over the units 10Y, 10M, 10C, and 10K in FIG. 1. The intermediate transfer belt 20 is wound around a drive roller 22 and a support roller 24, which are spaced apart from each other and brought into contact with the inner surface of the intermediate transfer belt 20. The intermediate transfer belt 20 runs clockwise in FIG. 1, i.e., in the direction from the first unit 10Y to the fourth unit 10K. Using a spring or the like (not shown), a force is applied to the support roller 24 in a direction away from the drive roller 22, thereby applying tension to the intermediate transfer belt 20 wound around the drive roller 22 and the support roller 24. An intermediate transfer body-cleaning device 30 is disposed so as to come into contact with the image-carrier-side surface of the intermediate transfer belt 20 and to face the drive roller 22.

Developing devices (i.e., developing units) 4Y, 4M, 4C, and 4K of units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same structure, the following description is made with reference to, as a representative, the first unit 10Y that forms an yellow image and is located upstream in a direction in which the intermediate transfer belt runs. Same members are labeled with the same reference numeral as the reference numeral of the first unit 10Y except that magenta (M), cyan (C), or black (K) is used instead of yellow (Y) and the description of the second to fourth units 10M, 10C, and 10K are omitted.

The first unit 10Y includes a photosensitive member 1Y serving as an image carrier. The following components are disposed around the photosensitive member 1Y sequentially in the counterclockwise direction: a charging roller (example of the charging unit) 2Y that charges the surface of the photosensitive member 1Y at a predetermined potential; an exposure device (example of the electrostatic-image forming unit) 3 that forms an electrostatic image by irradiating the charged surface of the photosensitive member 1Y with a laser beam 3Y based on a color separated image signal; a developing device (example of the developing unit) 4Y that develops the electrostatic image by supplying a charged toner to the electrostatic image; a first transfer roller (example of the first transfer subunit) 5Y that transfers the developed toner image to the intermediate transfer belt 20; and a photosensitive-member cleaning device (example of the cleaning unit) 6Y that removes a toner remaining on the surface of the photosensitive member 1Y after the first transfer.

The first transfer roller 5Y is disposed so as to be in contact with the inner surface of the intermediate transfer belt 20 and to face the photosensitive member 1Y. The first transfer rollers 5Y, 5M, 5C, and 5K are each connected to a bias power supply (not shown) that applies a first transfer bias to the first transfer rollers. Each bias power supply varies the transfer bias applied to the corresponding first transfer roller on the basis of the control by a controller (not shown).

The action of forming a yellow image in the first unit 10Y is described below.

Before the action starts, the surface of the photosensitive member 1Y is charged at a potential of −600 to −800 V by the charging roller 2Y.

The photosensitive member 1Y is formed by stacking a photosensitive layer on a conductive substrate (e.g., volume resistivity at 20° C.: $1\times10^{-6}$ Ωcm or less). The photosensitive layer is normally of high resistance (comparable with the resistance of ordinary resins), but, upon being irradiated with the laser beam 3Y, the specific resistance of the portion irradiated with the laser beam varies. Thus, the exposure device 3 irradiates the surface of the charged photosensitive member 1Y with the laser beam 3Y on the basis of the image data of the yellow image sent from the controller (not shown). The photosensitive layer on the surface of the photosensitive member 1Y is irradiated with the laser beam 3Y, and thereby an electrostatic image of yellow image pattern is formed on the surface of the photosensitive member 1Y.

The term "electrostatic image" used herein refers to an image formed on the surface of the photosensitive member 1Y by charging, the image being a "negative latent image" formed by irradiating a portion of the photosensitive layer with the laser beam 3Y to reduce the specific resistance of the irradiated portion such that the charges on the irradiated surface of the photosensitive member 1Y discharge while the charges on the portion that is not irradiated with the laser beam 3Y remain.

The electrostatic image, which is formed on the photosensitive member 1Y as described above, is sent to the predetermined developing position by the rotating photosensitive member 1Y. The electrostatic image on the photosensitive member 1Y is visualized (i.e., developed) in the form of a toner image by the developing device 4Y at the developing position.

The developing device 4Y includes an electrostatic-image developer including, for example, at least a yellow toner and a carrier. The yellow toner is stirred in the developing device 4Y to be charged by friction and supported on a developer roller (example of the developer support), carrying an electric charge of the same polarity (i.e., negative) as the electric charge generated on the photosensitive member 1Y. The yellow toner is electrostatically adhered to the eliminated latent image portion on the surface of the photosensitive member 1Y as the surface of the photosensitive member 1Y passes through the developing device 4Y. Thus, the latent image is developed using the yellow toner. The photosensitive member 1Y on which the yellow toner image is formed keeps rotating at the predetermined rate, thereby transporting the toner image developed on the photosensitive member 1Y to the predetermined first transfer position.

Upon the yellow toner image on the photosensitive member 1Y reaching the first transfer position, first transfer bias is applied to the first transfer roller 5Y so as to generate an electrostatic force on the toner image in the direction from the photosensitive member 1Y toward the first transfer roller 5Y. Thus, the toner image on the photosensitive member 1Y is transferred to the intermediate transfer belt 20. The transfer bias applied has the opposite polarity (+) to that of the toner (−) and controlled to be, for example, in the first unit 10Y, +10 μA by a controller (not shown).

The toner remaining on the photosensitive member 1Y is removed by the photosensitive-member cleaning device 6Y and then collected.

The first transfer biases applied to first transfer rollers 5M, 5C, and 5K of the second, third, and fourth units 10M, 10C, and 10K are each controlled in accordance with the first unit 10Y.

Thus, the intermediate transfer belt 20, on which the yellow toner image is transferred in the first unit 10Y, is successively transported through the second to fourth units 10M, 10C, and 10K while toner images of the respective colors are superimposed on top of another.

The resulting intermediate transfer belt 20 on which toner images of four colors are multiple-transferred in the first to fourth units is then transported to a second transfer section including a support roller 24 being in contact with the inner surface of the intermediate transfer belt 20 and a second transfer roller (example of the second transfer subunit) 26 disposed on the image-carrier-side of the intermediate transfer belt 20. A recording paper (example of the recording medium) P is fed by a feed mechanism into a narrow space between the second transfer roller 26 and the intermediate transfer belt 20 that are brought into contact with each other at the predetermined timing. The second transfer bias is then applied to the support roller 24. The transfer bias applied here has the same polarity (−) as that of the toner (−) and generates an electrostatic force on the toner image in the direction from the intermediate transfer belt 20 toward the recording paper P. Thus, the toner image on the intermediate transfer belt 20 is transferred to the recording paper P. The intensity of the second transfer bias applied is determined on the basis of the resistance of the second transfer section which is detected by a resistance detector (not shown) that detects the resistance of the second transfer section and controlled by changing voltage.

Subsequently, the recording paper P is transported into a nip part of the fixing device (example of the fixing unit) 28 at which a pair of fixing rollers are brought into contact with each other. The toner image is fixed to the recording paper P to form a fixed image.

Examples of the recording paper P to which a toner image is transferred include plain paper used in electrophotographic copiers, printers, and the like. Examples of a recording medium other than the recording paper P include OHP films.

In order to enhance the smoothness of the surface of the fixed image, the surface of the recording paper P may also be smooth. Examples of such a recording paper include coated paper produced by coating the surface of plain paper with resin or the like and art paper for printing.

The recording paper P, to which the color image has been fixed, is transported toward an exit portion. Thus, the series of the steps for forming a color image are terminated.

Process Cartridge and Toner Cartridge

The process cartridge according to an exemplary embodiment is described below.

The process cartridge according to the exemplary embodiment includes a developing unit that includes the electrostatic-image developer according to the above-described exemplary embodiment and develops an electrostatic image formed on the surface of an image carrier using the electrostatic-image developer to form a toner image. The process cartridge according to the exemplary embodiment is detachably attachable to an image forming apparatus.

The structure of the process cartridge according to the exemplary embodiment is not limited to the above-described one. The process cartridge according to the exemplary embodiment may further include, in addition to the developing unit, at least one unit selected from an image carrier, a charging unit, an electrostatic-image forming unit, a transfer unit, and the like as needed.

An example of the process cartridge according to the exemplary embodiment is described below, but the process cartridge is not limited thereto. Only components illustrated in FIG. 2 are described; others are omitted.

The process cartridge may include a developer holding member for holding and supplying the electrostatic-image developer and a container that accommodates the electrostatic-image developer.

Figure 2:
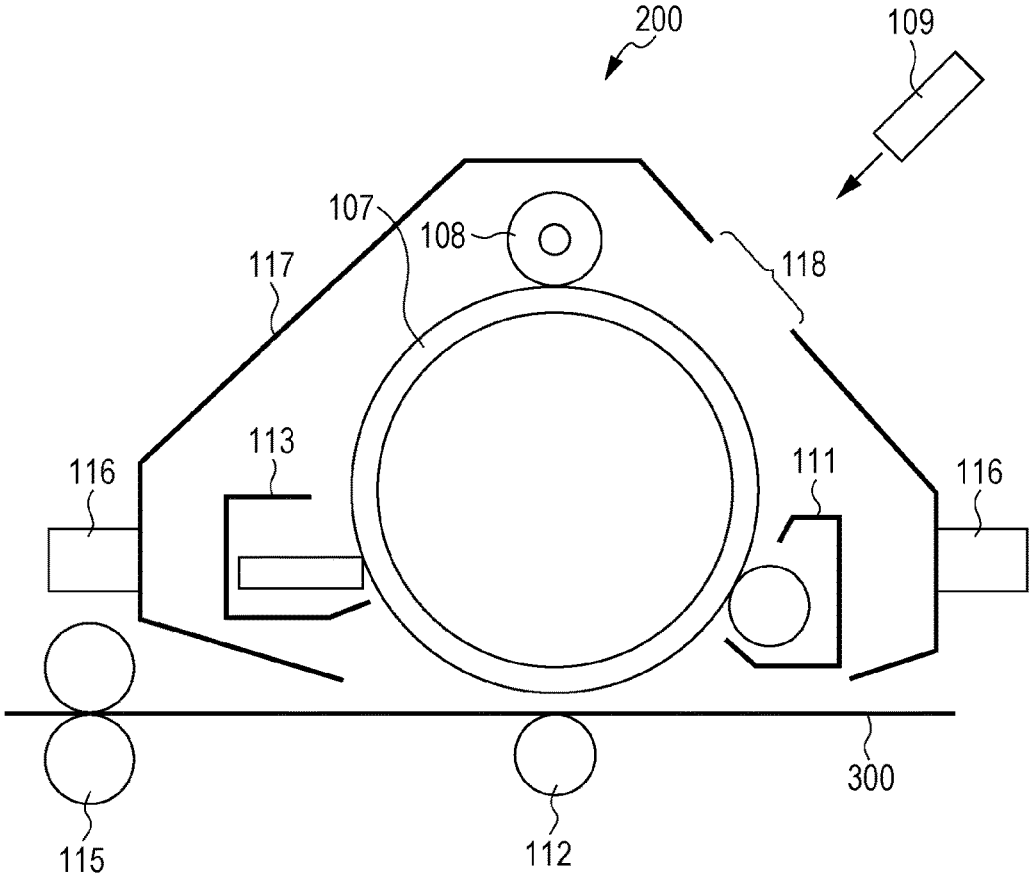
FIG. 2 schematically illustrates an example of a process cartridge according to an exemplary embodiment.

FIG. 2 schematically illustrates the process cartridge according to the exemplary embodiment.

A process cartridge 200 illustrated in FIG. 2 includes, for example, a photosensitive member 107 (example of the image carrier), a charging roller 108 (example of the charging unit) disposed on the periphery of the photosensitive member 107, a developing device 111 (example of the developing unit), and a photosensitive-member-cleaning device 113 (example of the cleaning unit), which are combined into one unit using a housing 117 to form a cartridge.

The housing 117 has an aperture 118 for exposure. A mounting rail 116 is disposed on the housing 117.

In FIG. 2, Reference numeral 109 denotes an exposure device (example of the electrostatic-image forming unit), Reference numeral 112 denotes a transfer device (example of the transfer unit), Reference numeral 115 denotes a fixing device (example of the fixing unit), and the Reference numeral 300 denotes recording paper (example of the recording medium).

The toner cartridge according to an exemplary embodiment is described below.

The toner cartridge according to the exemplary embodiment includes the toner according to the above-described exemplary embodiment and is detachably attachable to an image forming apparatus. The toner cartridge includes a toner that is to be supplied to a developing unit disposed inside an image forming apparatus.

The image forming apparatus illustrated in FIG. 1 includes toner cartridges 8Y, 8M, 8C, and 8K detachably attached thereto. Developing devices 4Y, 4M, 4C, and 4K are each connected to the toner cartridge associated with each developing device (i.e., each color) through a toner supply tube (not shown). The toner cartridge is exchanged when the amount of toner stored in the toner cartridge is small.

EXAMPLES

The above-described exemplary embodiments are described specifically with reference to Examples and Comparative Examples below, but the above-described exemplary embodiments are not limited thereto. In Examples and Comparative Examples, all "part" and "%" are by mass unless otherwise specified.

Preparation of Dispersion of Polyester Resin PE1

Bisphenol A-ethylene oxide 2-mol adduct: 10 mol %

Bisphenol A-propylene oxide 2-mol adduct: 40 mol %

Terephthalic acid: 40 mol %

Dodecenyl succinic anhydride: 5 mol %

Trimellitic anhydride: 5 mol %

The above monomer components were charged into a reactor equipped with a stirrer, a thermometer, a condenser, and a nitrogen-gas introduction tube. After the reactor was purged with dry nitrogen gas, dibutyltin oxide was added to the reactor as a catalyst such that the amount of the dibutyltin oxide was 1.0% of the total amount of the above monomer components. The resulting mixture was stirred under a nitrogen gas stream at 190° C. for 5 hours to cause a reaction. Subsequently, the temperature was increased to 240° C. and the reaction was continued for 6 hours under stirring. Then, the pressure inside the reactor was reduced to 10.0 mmHg, and the reaction was further continued for 0.5 hours under a reduced pressure while the mixture was stirred. Thus, a yellow transparent polyester resin PE1 was prepared. The polyester resin PE1 had a glass transition temperature of 55° C.

A dispersion of the polyester resin PE1 was formed using a disperser prepared by adapting a "CAVITRON CD1010" (produced by Eurotec, Ltd.) for high-temperature, high-pressure use. Specifically, the composition ratio of ion-exchange water to the polyester resin PE1 was set to 80:20, the pH of the dispersion was set to 8.5 using ammonia, and CAVITRON was operated under the following conditions: rotation speed of rotor: 60 Hz; pressure: 5 kg/cm$^2$; and heating temperature of heat exchanger: 140° C. Thus, a dispersion (solid content: 20%) of the polyester resin PE1 was prepared.

Preparation of Dispersion of Polyester Resin PE2

Dibutyltin oxide was mixed with a mixture of sebacic acid (50 mol %) and 1,6-hexanediol (50 mol %) in a flask such that the amount of dibutyltin oxide was 0.3% of the total amount of the monomer components (i.e., sebacic acid and 1,6-hexanediol). The resulting mixture was heated to 240° C. under a reduced-pressure atmosphere, and a dehydration condensation reaction was performed for 6 hours to prepare a polyester resin PE2.

Subsequently, 300 parts of the polyester resin PE2, 160 parts of methyl ethyl ketone (solvent), and 100 parts of isopropyl alcohol (solvent) were charged into a 3-litter jacket-type reaction vessel ("BJ-30N" produced by TOKYO RIKAKIKAI CO, LTD) equipped with a condenser, a thermometer, a water dropper, and an anchor stirring shaft. These components were mixed under stirring at 100 rpm while the temperature was maintained to be 70° C. in a water-circulation-type thermostat in order to dissolve the resin (Solution Preparation Step).

Subsequently, the number of rotation of the stirrer was set to 150 rpm, and the temperature of the water-circulation-type thermostat was set to 66° C. To the solution of the polyester resin PE2, 17 parts of a 10%-ammonia water (reagent) was added over 10 minutes, and subsequently 900 parts of ion-exchange water kept at 66° C. was added dropwise to the resulting solution at a rate of 7 part/min in order to perform phase inversion. Thus, an emulsion was prepared.

Immediately after preparation of the emulsion, 800 parts of the emulsion and 700 parts of ion-exchange water were charged into a 2-litter eggplant flask, and the flask was fixed to an evaporator (produced by TOKYO RIKAKIKAI CO, LTD) equipped with a vacuum control unit with a trap ball interposed between the flask and the evaporator. The mixture was heated in a hot-water bath kept at 60° C. while the eggplant flask was rotated, and the pressure inside the flask was reduced to 7 kPa while taking care to prevent bumping. Thus, the solvents were removed. When the amount of the solvents collected reached 1,100 parts, the pressure inside the eggplant flask was increased to the normal pressure, and the eggplant flask was water-cooled to prepare a dispersion. The solid-content concentration in the dispersion was controlled to be 20% by adding ion-exchange water to the dispersion. Thus, a dispersion of the polyester resin PE2 was prepared.

Preparation of Dispersion of Styrene-(Meth)acrylic Resin

Styrene (produced by Wako Pure Chemical Industries, Ltd.): 450 parts n-Butyl acrylate (produced by Wako Pure Chemical Industries, Ltd.): 120 parts 1,10-Decanediol diacrylate (produced by Shin Nakamura Chemical Co., Ltd.): 2 parts Dodecanethiol (produced by Wako Pure Chemical Industries, Ltd.): 4 parts The above components were mixed together and dissolved in a flask. A solution prepared by dissolving 4.5 parts of an anionic surfactant "Dowfax" (produced by Dow Chemical Company) in 1,050 parts of ion-exchange water was added to the flask, and emulsification was performed in the flask. While the contents of the flask were slowly stirred for 10 minutes, 50 parts of ion-exchange water in which 5 parts of ammonium persulfate was dissolved was further added to the flask. Then, after the flask was purged with nitrogen, the solution contained in the flask was heated to 65° C. in an oil bath while being stirred, and emulsion polymerization was continued for 5 hours. Thus, a dispersion of a styrene-(meth)acrylic resin which had a solid content of 37% was prepared. The styrene-(meth)acrylic resin had a glass transition temperature of 60° C.

Preparation of Colorant Particle Dispersion

Carbon black ("Regal330" produced by Cabot Corporation): 250 parts

Anionic surfactant ("Neogen SC" produced by DKS Co. Ltd., active ingredient: 60%): 33 parts (8% of the amount of colorant in terms of active ingredient)

Ion-exchange water: 750 parts

Into a stainless steel container having a size such that, when all the above components are charged into the container, the level of the liquid surface reaches about ⅓ of the height of the container, a portion (280 parts) of the ion-exchange water and 33 parts of the anionic surfactant were charged. After the surfactant was dissolved to a sufficient degree, the whole amount of the solid solution pigment was added to the container. The resulting mixture was stirred using a stirrer until all the pigment particles became wet, and degassing was performed to a sufficient degree. After degassing was completed, the remaining portion of the ion-exchange water was added to the container, and dispersion was performed using a homogenizer ("ULTRA-TURRAX T50" produced by IKA) at 5,000 rpm for 10 minutes. Subsequently, stirring was performed with a stirrer the whole day to perform degassing. After degassing was completed, dispersion was again performed using the homogenizer at 6,000 rpm for 10 minutes. Subsequently, stirring was performed with a stirrer the whole day to perform degassing. The resulting dispersion was subjected to a high-pressure-impact-type disperser Ultimaizer ("HJP30006" produced by Sugino Machine Limited) at a pressure of 240 MPa in order to perform dispersion. Dispersion was performed to a level equivalent to 25 passes in consideration of the total amount of the dispersion charged and the capacity of the apparatus. The resulting dispersion was left standing for 72 hours to remove a precipitate. The solid content concentration in the dispersion was controlled to be 20% by adding ion-exchange water to the dispersion. Thus, a colorant particle dispersion was prepared.

Preparation of Release-Agent Particle Dispersion

Polyethylene wax (hydrocarbon wax, product name "Polywax 725" produced by Baker Petrolite): 270 parts Anionic surfactant ("Neogen RK" produced by Dai-ichi Kogyo Seiyaku Co., Ltd., active ingredient: 60%): 13.5 parts (3.0% of the amount of release agent in terms of active ingredient)

Ion-exchange water: 21.6 parts

The above components were mixed together, and the release agent was dissolved in the mixture using a pressure-discharge-type homogenizer (Gaulin homogenizer produced by Gaulin) at an inner-liquid temperature of 120° C. The resulting solution was subjected to dispersion at a dispersion pressure of 5 MPa for 120 minutes and subsequently subjected to further dispersion at 40 MPa for 360 minutes. The resulting dispersion was cooled to form a release-agent particle dispersion. The solid content concentration in the dispersion was controlled to be 20.0% by adding ion-exchange water to the dispersion.

Preparation of Aqueous Aluminium Sulfate Solution

Aluminium sulfate powder (produced by ASADA CHEMICAL INDUSTRY CO., LTD.: 17% aluminium sulfate): 35 parts Ion-exchange water: 2 parts The above components were charged into a container, and the resulting mixture was stirred at 30° C. until the precipitate disappeared. Thus, an aqueous aluminium sulfate solution was prepared.

Preparation of Toner Particles (1)

Dispersion of polyester resin particles PE1: 250 parts

Dispersion of polyester resin PE2: 25 parts

Styrene-(meth)acrylic resin dispersion: 70 parts

Colorant particle dispersion: 30 parts

Release-agent particle dispersion: 40 parts

Ion-exchange water: 150 parts

Anionic surfactant ("Dowfax2A1" produced by Dow Chemical Company): 3 parts

The above components were charged into a 3-litter reactor equipped with a thermometer, a pH-meter, and a stirrer. After the pH of the resulting mixture was changed to 4.0 by adding 1.0%-nitric acid to the mixture at 25° C., 18 parts of the aqueous aluminium sulfate solution prepared above was added to the mixture while dispersion was performed using a homogenizer ("ULTRA-TURRAX T50" produced by IKA Japan) at 5,000 rpm. Then, dispersion was performed for 3 minutes.

Subsequently, a stirrer and a heating mantle were attached to the reactor. The temperature was increased at a heating rate of 0.2° C./min until the temperature reached 40° C. and at a heating rate of 0.05° C./min after the temperature exceeded 40° C. while the number of rotation of the stirrer was controlled such that the slurry was stirred to a sufficient degree. During heating, the volume-average diameter of the resulting resin particles was measured every 10 minutes using "Multisizer II" (aperture diameter: 50 μm, produced by Coulter). When the volume-average diameter of the resin particles reached 5.4 μm, the temperature was maintained to be constant and 100 parts of the dispersion of the polyester resin particles PE1 was added to the reactor over 3 minutes.

After the temperature was maintained to be constant for 30 minutes, the pH of the mixture was controlled to be 8.5 using a 1%-aqueous sodium hydroxide solution. Subsequently, the mixture was heated to 90° C. at a heating rate of 1° C./min while the pH of the mixture was maintained to be 8.5 at intervals of 10° C. in the above-described manner. Then, the temperature of the mixture was maintained to be constant. Observation of the shape and surfaces of the particles using an optical microscope and an electron scanning microscope (FE-SEM) confirmed that coalescence of the particles occurred after 4 hours. Then, the container was cooled to 35° C. over 5 minutes using cooling water.

The cooled slurry was passed through a nylon mesh having a sieve opening of 15 μm in order to remove coarse powder particles. The slurry containing toner particles that passed through the mesh was filtered using an aspirator under a reduced pressure. Toner particles that remained on the filter paper were pulverized manually, and the pulverized toner particles were added to ion-exchange water of an amount ten times the amount of toner particles at 30° C. The resulting mixture was stirred for 30 minutes. Subsequently, the mixture was filtered using the aspirator under a reduced pressure. Toner particles that remained on a filter paper were pulverized manually, and the pulverized toner particles were added to ion-exchange water of an amount ten times the amount of toner particles at 30° C. The resulting mixture was stirred for 30 minutes. The mixture was again filtered using the aspirator under a reduced pressure, and the electric conductivity of the resulting filtrate was measured. The above-described operation was repeated until the electric conductivity of the filtrate reached 10 μS/cm or less to clean the toner particles.

The cleaned toner particles were finely pulverized using a wet-dry granulator (Comil) and subsequently dried in vacuum in an oven kept at 35° C. for 40 hours. Thus, toner particles (1) were prepared.

The number-average diameter $D50_T$ of the toner particles (1) and the proportion of the styrene-(meth)acrylic resin in the resin component deposited on the toner particle surfaces were determined by the above-described methods. For toner particles (2) to (12) described below, the number-average diameter $D50_T$ of the toner particles and the proportion of the styrene-(meth)acrylic resin in resin components deposited on the toner particle surfaces were also determined in the above-described manner. Table 1 summarizes the results.

Preparation of Toner Particles (2)

The toner particles (2) were prepared as in the preparation of the toner particles (1), except that the amount of the aqueous aluminium sulfate solution was changed to 25 parts and the temperature was maintained to be constant when the volume-average diameter of the resin particles reached 11.0 μm while, in preparation of the toner particles (1), the temperature was maintained to be constant when the volume-average diameter of the resin particles reached 5.4 μm.

Preparation of Toner Particles (3)

The toner particles (3) were prepared as in the preparation of the toner particles (1), except that the amount of the aqueous aluminium sulfate solution was changed to 4 parts and the temperature was maintained to be constant when the volume-average diameter of the resin particles reached 2.2 μm while, in preparation of the toner particles (1), the temperature was maintained to be constant when the volume-average diameter of the resin particles reached 5.4 μm.

Preparation of Toner Particles (4) to (7) and (11)

The toner particles (4) to (7) and (11) were prepared as in the preparation of the toner particles (1), except that the amount of the styrene-(meth)acrylic resin dispersion added was changed as described in Table 1.

Preparation of Toner Particles (8)

The toner particles (8) were prepared as in the preparation of the toner particles (1), except that the amount of the dispersion of the polyester resin particles PE1, which was added after the temperature was maintained to be constant when the volume-average diameter of the resin particles reached 5.4 μm, was changed to 50 parts and the amount of the styrene-(meth)acrylic resin dispersion added was changed as described in Table 1.

Preparation of Toner Particles (9)

The toner particles (9) were prepared as in the preparation of the toner particles (1), except that the amount of the dispersion of the polyester resin particles PE1, which was added after the temperature was maintained to be constant when the volume-average diameter of the resin particles reached 5.4 μm, was changed to 150 parts and the amount of the styrene-(meth)acrylic resin dispersion added was changed as described in Table 1.

Preparation of Toner Particles (10) and (12)

The toner particles (10) and (12) were prepared as in the preparation of the toner particles (1), except that the amount of the dispersion of the polyester resin particles PE1, which was added after the temperature was maintained to be constant when the volume-average diameter of the resin particles reached 5.4 μm, was changed to 80 parts and the amount of the styrene-(meth)acrylic resin dispersion added was changed as described in Table 1.

TABLE 1

| | | St/Ac resin | | |
|---|---|---|---|---|
| Type of toner particles | $D50_T$ [μm] | Amount of dispersion added [parts] | Content [parts] | Proportion in toner particle surfaces [atm %] |
| Toner particles (1) | 6.5 | 70 | 20 | 15 |
| Toner particles (2) | 12.5 | 70 | 20 | 12 |
| Toner particles (3) | 2.8 | 70 | 20 | 25 |
| Toner particles (4) | 6.5 | 56 | 25 | 19 |
| Toner particles (5) | 6.5 | 62 | 28 | 21 |
| Toner particles (6) | 6.5 | 70 | 32 | 24 |
| Toner particles (7) | 6.5 | 76 | 35 | 26 |
| Toner particles (8) | 6.5 | 10.6 | 4.8 | 6.4 |
| Toner particles (9) | 6.5 | 15 | 7 | 5.2 |
| Toner particles (10) | 6.5 | 14 | 6 | 4.8 |
| Toner particles (11) | 6.5 | 85 | 39 | 29 |
| Toner particles (12) | 6.5 | 94 | 43 | 32 |

In Table 1, "St/Ac Resin" refers to the styrene-(meth) acrylic resin, "Content" refers to the amount of the styrene-(meth)acrylic resin relative to 100 parts by mass of the toner particles, and "Proportion in toner particle surfaces" refers to the proportion (i.e., exposure ratio) of the styrene-(meth) acrylic resin in resin components deposited on the toner particle surfaces which was measured by XPS.

Preparation of Polymethyl Methacrylate Particles (AC1)

A monomer dispersion was prepared by mixing 100 parts of methyl methacrylate that served as a monomer, 1 part of ammonium persulfate that served as a polymerization initiator, 0.5 parts of sodium dodecylbenzenesulfonate that served as a suspension adjuvant, and 200 parts of ion-exchange water. The monomer dispersion was stirred at 70° C. for 7 hours at 800 rpm. Thus, a suspension containing poly(methyl methacrylate) particles dispersed in water was prepared.

A portion of the suspension was dried to obtain poly (methyl methacrylate) particles (AC1), and the number-average diameter $D50_P$ of the poly(methyl methacrylate) particles (AC1) was determined by the above-described method. For each of the poly[alkyl (meth)acrylate] particles (AC2) to (AC9) described below, the number-average diameter $D50_P$ of the poly(methyl methacrylate) particles was determined in the above-described manner. Table 2 summarizes the results.

Preparation of Poly(Methyl Methacrylate) Particles (AC2)

Poly(methyl methacrylate) particles (AC2) were prepared as in the preparation of the poly(methyl methacrylate) particles (AC1), except that the number of rotation at which stirring was performed was changed to 1,200 rpm.

Preparation of Poly(Methyl Methacrylate) Particles (AC3)

Poly(methyl methacrylate) particles (AC3) were prepared as in the preparation of the poly(methyl methacrylate) particles (AC1), except that the number of rotation at which stirring was performed was changed to 300 rpm.

Preparation of Poly-(n-Hexyl Methacrylate) Particles (AC4)

Poly-(n-hexyl methacrylate) particles (AC4) were prepared as in the preparation of the poly(methyl methacrylate) particles (AC1), except that the monomer, that is, methyl methacrylate, was changed to n-hexyl methacrylate.

Preparation of Poly-(n-Propyl Methacrylate) Particles (AC5)

Poly-(n-propyl methacrylate) particles (AC5) were prepared as in the preparation of the poly(methyl methacrylate) particles (AC1), except that the monomer, that is, methyl methacrylate, was changed to n-propyl methacrylate.

Preparation of Poly(Methyl Methacrylate) Particles (AC6)

Poly(methyl methacrylate) particles (AC6) were prepared as in the preparation of the poly(methyl methacrylate) particles (AC1), except that the number of rotation at which stirring was performed was changed to 600 rpm.

Preparation of Poly(Methyl Methacrylate) Particles (AC7)

Poly(methyl methacrylate) particles (AC7) were prepared as in the preparation of the poly(methyl methacrylate) particles (AC1), except that the number of rotation at which stirring was performed was changed to 1,050 rpm.

Preparation of Poly(Methyl Methacrylate) Particles (AC8)

Poly(methyl methacrylate) particles (AC8) were prepared as in the preparation of the poly(methyl methacrylate) particles (AC1), except that the number of rotation at which stirring was performed was changed to 540 rpm.

Preparation of Poly-(n-Pentyl Methacrylate) Particles (AC9)

Poly-(n-pentyl methacrylate) particles (AC9) were prepared as in the preparation of the poly(methyl methacrylate) particles (AC1), except that the monomer, that is, methyl methacrylate, was changed to n-pentyl methacrylate.

TABLE 2

| Type of poly [alkyl (meth)acrylate] particles | $D50_P$ [nm] | Number of carbon atoms in alkyl chain |
|---|---|---|
| (AC1) | 400 | C1 |
| (AC2) | 150 | C1 |
| (AC3) | 1000 | C1 |
| (AC4) | 400 | C6 |
| (AC5) | 400 | C3 |
| (AC6) | 600 | C1 |
| (AC7) | 220 | C1 |
| (AC8) | 780 | C1 |
| (AC9) | 400 | C5 |

Example 1

Preparation of Toner 1

Toner particles (1): 100 parts

Poly(methyl methacrylate) particles (AC1): 0.12 parts

Silica particles (product name "RY50" produced by NIPPON AEROSIL CO., LTD., volume-average particle diameter: 0.04 μm): 3 parts The above components were mixed together using a HENSCHEL mixer at a peripheral speed of 20 m/s for 15 minutes. Thus, a toner 1 of Example 1 was prepared.

Examples 2 to 17 and Comparative Examples 1 to 6

Toners 2 to 17 of Examples 2 to 17 and toners C1 to C6 of Comparative examples 1 to 6 were each prepared as in the preparation of the toner 1 of Example 1, except that the type of toner particles and the type and content of poly[alkyl (meth)acrylate] particles were changed as described in Table 3.

Evaluation

For each of the toners prepared in Examples and Comparative examples above, the ratio of a change in packed bulk density and a change in the gradation reproducibility of images were evaluated.

Ratio of Change in Packed Bulk Density

For each of the toners prepared in Examples and Comparative examples (hereinafter, referred to as "toner before storage"), the packed bulk density (hereinafter, referred to as "packed bulk density before storage") of the toner was measured by the above-described method.

Subsequently, each toner was charged into a toner cartridge and stored in the toner cartridge at 40° C. for 20 hours. Hereinafter, the toner that had been stored in the above-described manner is referred to as "toner after storage".

For each of the toners after storage, the packed bulk density (hereinafter, referred to as "packed bulk density after storage") of the toner was measured as in the measurement of those of the toners before storage.

The ratio of a change in packed bulk density was calculated from packed bulk density before storage and packed bulk density after storage using the following formula. Table 3 summarizes the results.

Ratio of Change in Packed Bulk Density=Packed Bulk Density after Storage/Packed Bulk Density Before Storage Evaluation of Change in Gradation Reproducibility A carrier and a developer were prepared by the following method, and subsequently gradation reproducibility before storage and gradation reproducibility after storage were evaluated.

Preparation of Carrier

Styrene-methyl methacrylate copolymer (mass ratio: 70/30): 5 parts

Toluene: 15 parts

Carbon black ("Regal330" produced by Cabot Corporation): 1 part

The above components were mixed together, and the resulting mixture was stirred for 10 minutes with a stirrer. Thus, a coating-layer forming solution was prepared. The coating-layer forming solution and 100 parts of ferrite particles (volume-average particle diameter: 40 μm) were charged into a vacuum-degassing-type kneader, and the resulting mixture was stirred at 60° C. for 30 minutes. Subsequently, degassing was performed under a reduced pressure while the temperature was increased. Then, drying was performed. Thus, a carrier was prepared.

Preparation of Developer

Using a V-blender, 8 parts of the toner before storage prepared in each of Examples and Comparative examples was mixed with 92 parts of the carrier to prepare a developer.

Evaluation of Gradation Reproducibility Before Storage

A toner cartridge filled with the toner before storage prepared in each example was attached to an image forming apparatus ("DocuPrint P450d" produced by Fuji Xerox Co., Ltd.), and the corresponding one of the developers prepared above was charged into a developing device of the image forming apparatus.

Using this image forming apparatus, five halftone images were sequentially printed on A4 sheets of paper at an area coverage of 50% at room temperature (20° C.) while the toner before storage was supplied from the toner cartridge to the developing device. The density of the third image was measured.

Evaluation of gradation reproducibility before storage was made on the basis of a difference (hereinafter, referred to as "Δimage density") between the image density measured and the density of a halftone image formed at a targeted area coverage of 50% (i.e., targeted image density). Table 3 summarizes the results.

The evaluation was made in accordance with the following criteria. Measurement of image density and targeted image density was made using a reflection densitometer "X-Rite938" (produced by X-Rite, Incorporated).

Evaluation Criteria

G1: Δimage density (SAD)≤0.1

G2: 0.1<Δimage density (SAD)≤0.2

G3: 0.2<Δimage density (SAD)≤0.3

G4: 0.3<Δimage density (SAD)≤0.4

G5: 0.4<Δimage density (SAD)

Evaluation of Gradation Reproducibility after Storage

Evaluation of gradation reproducibility after storage was made as in the evaluation of gradation reproducibility before storage, except that the toner cartridge attached to each image forming apparatus was filled with the toner after storage and the developer prepared above was charged into a developing device of the image forming apparatus. Table 3 summarizes the results.

In Examples 1, 4, and 10 where the resin particles (AC1), (AC5), and (AC9), respectively, which included poly[alkyl (meth)acrylate] particles having an alkyl chain including 1 to 5 carbon atoms, were used, the Δimage density after storage was likely to be smaller than in Example 13 where the resin particles (AC4), which included an alkyl chain having more than 5 carbon atoms, were used.

In Examples, the ratio of a change in packed bulk density was closer to 1 than in Comparative Examples. In Comparative Example 2, although the ratio of a change in packed bulk density was close to 1, an aggregate of the resin particles was formed since the amount of the poly[alkyl (meth)acrylate] particles added was large, which caused obvious image defects such as black dots.

TABLE 3

| | | Poly [alkyl (meth)acrylate] particles | | | | Packed bulk density before storage [g/cm$^3$] | Packed bulk density after storage [g/cm$^3$] | Ratio of change in packed bulk density | Evaluation of gradation reproducibility | |
|---|---|---|---|---|---|---|---|---|---|---|
| | Type of toner | Type of toner particles | Type | Content [parts] | $D50_P/D50_T$ | | | | Gradation reproducibility before storage | Gradation reproducibility after storage |
| Example 1 | 1 | (1) | (AC1) | 0.12 | 0.062 | 0.644 | 0.650 | 1.01 | G1 | G1 |
| Comparative example 1 | C1 | (1) | — | 0 | — | 0.644 | 0.669 | 1.04 | G1 | G5 |
| Comparative example 2 | C2 | (1) | (AC1) | 1.2 | 0.062 | 0.618 | 0.619 | 1.00 | G1 | G5 |
| Comparative example 3 | C3 | (2) | (AC2) | 0.12 | 0.012 | 0.605 | 0.630 | 1.04 | G1 | G5 |
| Comparative example 4 | C4 | (3) | (AC3) | 0.12 | 0.357 | 0.652 | 0.684 | 1.05 | G1 | G5 |
| Example 13 | 13 | (1) | (AC4) | 0.12 | 0.062 | 0.644 | 0.661 | 1.03 | G1 | G4 |
| Example 14 | 14 | (4) | (AC1) | 0.12 | 0.062 | 0.638 | 0.656 | 1.03 | G1 | G1 |
| Example 2 | 2 | (1) | (AC1) | 0.05 | 0.062 | 0.650 | 0.660 | 1.015 | G1 | G2 |
| Example 3 | 3 | (1) | (AC1) | 0.25 | 0.062 | 0.640 | 0.648 | 1.013 | G1 | G2 |
| Example 4 | 4 | (1) | (AC5) | 0.12 | 0.062 | 0.644 | 0.652 | 1.012 | G1 | G2 |
| Example 5 | 5 | (1) | (AC6) | 0.12 | 0.092 | 0.639 | 0.648 | 1.014 | G1 | G2 |
| Example 6 | 6 | (5) | (AC1) | 0.12 | 0.062 | 0.642 | 0.652 | 1.016 | G1 | G2 |
| Example 7 | 7 | (1) | (AC1) | 1 | 0.062 | 0.625 | 0.640 | 1.024 | G1 | G3 |
| Example 8 | 8 | (1) | (AC7) | 0.12 | 0.034 | 0.649 | 0.663 | 1.022 | G1 | G3 |
| Example 9 | 9 | (1) | (AC8) | 0.12 | 0.12 | 0.620 | 0.632 | 1.02 | G1 | G3 |
| Example 10 | 10 | (1) | (AC9) | 0.12 | 0.062 | 0.642 | 0.657 | 1.023 | G1 | G3 |
| Example 11 | 11 | (6) | (AC1) | 0.12 | 0.062 | 0.629 | 0.643 | 1.022 | G1 | G2 |
| Example 12 | 12 | (7) | (AC1) | 0.12 | 0.062 | 0.644 | 0.657 | 1.020 | G1 | G3 |
| Example 15 | 15 | (8) | (AC1) | 0.12 | 0.062 | 0.609 | 0.627 | 1.03 | G1 | G2 |
| Example 16 | 16 | (9) | (AC1) | 0.12 | 0.062 | 0.603 | 0.627 | 1.04 | G1 | G3 |
| Example 17 | 17 | (11) | (AC1) | 0.12 | 0.062 | 0.653 | 0.686 | 1.05 | G1 | G3 |
| Comparative example 5 | C5 | (10) | (AC1) | 0.12 | 0.062 | 0.606 | 0.624 | 1.03 | G1 | G5 |
| Comparative example 6 | C6 | (12) | (AC1) | 0.12 | 0.062 | 0.655 | 0.675 | 1.03 | G1 | G5 |

In Table 3, "$D50_P/D50_T$" refers to the ratio of the number-average diameter $D50_P$ of the poly[alkyl (meth)acrylate] particles to the number-average diameter $D50_T$ of the toner particles.

The evaluation results described in Table 3 show that, in Examples, both Δimage density (i.e., difference between the image density measured and the targeted image density) before storage and Δimage density after storage were smaller than in Comparative Examples. Although Δimage density before storage was small in Examples and Comparative Examples, Δimage density after storage was small in Examples but large in Comparative Examples. This confirms that using the toners prepared in Examples for forming images reduced a change in gradation reproducibility of the images which occurred when the toner was stored in a toner cartridge over a long period of time.

In Examples 1, 6, and 14 in which toner particles (1), (4), or (5), which included 5 parts by mass or more and 30 parts by mass or less of the styrene-(meth)acrylic resin relative to 100 parts by mass of the toner particles, were used, Δimage density after storage was likely to be smaller than in Examples 11, 12, 15, and 17 in which any one of the toner particles (6) to (8) and (11), which included less than 5 parts by mass or more than 30 parts by mass of the styrene-(meth) acrylic resin relative to 100 parts by mass of the toner particles, were used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic-image developing toner comprising:

a toner particle including a polyester resin and a styrene-(meth)acrylic resin; and an external additive including a poly[alkyl (meth)acrylate] particle, an amount of the poly[alkyl (meth)acrylate] particles being about 0.05 parts by mass or more and about 1.0 parts by mass or less relative to 100 parts by mass of the toner particle, a ratio $D50_P/D50_T$ of a number-average diameter $D50_P$ of the poly[alkyl (meth)acrylate] particles to a number-average diameter $D50_T$ of the toner particles satisfying $0.03 \leq D50_P/D50_T \leq 0.15$, a proportion of the styrene-(meth)acrylic resin in a resin component deposited on a surface of the toner particle being about 5 atom % or more and about 30 atom % or less as determined by X-ray photoelectron spectroscopy (XPS), and a ratio of a packed bulk density of the toner after storage to a packed bulk density of the toner before storage, that is, packed bulk density after storage/packed bulk density before storage, is about 1.03 or less, wherein packed bulk density is measured as follows:

a toner to be measured is charged into a container having a diameter of 5 cm, a height of 5.2 cm, and a volume of 100 $cm^3$, and then a cap is attached, a tapping impact is repeatedly performed on a bottom of the charged container 180 times, after tapping is completed, the cap is removed and any excess portion of the toner protruding from the container is leveled off, and after removing any excess portion of the toner, the packed bulk density of the toner is determined, in units of $g/cm^3$, from an amount of the toner charged in the container, and wherein the packed bulk density after storage is determined using toner that has been stored in a toner cartridge at 40° C. for 20 hours.

2. The electrostatic-image developing toner according to claim 1, wherein an amount of the styrene-(meth)acrylic resin is about 5 parts by mass or more and about 30 parts by mass or less relative to 100 parts by mass of the toner particle.

3. The electrostatic-image developing toner according to claim 1, wherein the poly[alkyl (meth)acrylate] particle includes an alkyl chain having 1 to 5 carbon atoms.

4. The electrostatic-image developing toner according to claim 1, wherein the number-average diameter $D50_P$ of the poly [alkyl (meth)acrylate] particles is about 200 nm or more and about 800 nm or less.

5. The electrostatic-image developing toner according to claim 1, wherein the polyester resin has a glass transition temperature of about 50° C. or more and about 65° C. or less.

6. The electrostatic-image developing toner according to claim 1, further comprising a release agent having a melting temperature of about 60° C. or more and about 100° C. or less.

7. The electrostatic-image developing toner according to claim 1, wherein the toner particle has a shape factor SF1 of about 120 or more and about 140 or less.

8. An electrostatic-image developer comprising the electrostatic-image developing toner according to claim 1.

9. A toner cartridge comprising the electrostatic-image developing toner according to claim 1, the toner cartridge being detachably attachable to an image forming apparatus.

10. The electrostatic-image developing toner according to claim 1, wherein the ratio of the packed bulk density of the toner after storage to the packed bulk density of the toner before storage is 1.03 or less.

11. The electrostatic-image developing toner according to claim 1, wherein the ratio of the packed bulk density of the toner after storage to the packed bulk density of the toner before storage is 1.02 or less.

* * * * *